United States Patent [19]

Martin

[11] 3,992,000

[45] Nov. 16, 1976

[54] SHEET STRIPPER

[75] Inventor: Harvey G. Martin, Royston, England

[73] Assignee: Xerox Corporation, Stamford, Conn.

[22] Filed: Oct. 6, 1975

[21] Appl. No.: 619,766

[30] Foreign Application Priority Data

Nov. 20, 1974 United Kingdom ..... 50307/74

[52] U.S. Cl. ..... 271/174; 118/245; 271/DIG. 2; 271/80

[51] Int. Cl.[2] ..... B65H 29/54

[58] Field of Search ..... 271/174, 80, DIG. 2; 226/5; 432/60; 100/174; 118/60, 245; 34/120

[56] References Cited

UNITED STATES PATENTS 3,578,859 5/1971 Stillings ..... 271/80 X 3,827,394 8/1974 Takahashi ..... 118/60 X

*Primary Examiner*—Richard A. Schacher

[57] ABSTRACT

In electrostatographic copying apparatus, a device for stripping copy sheets from an arcuate photoreceptor imaging surface comprising a stripping element having minor bearing surfaces only adjacent its leading and trailing ends and arranged to be pivotably connected to a support element at a first pivot point equidistant the bearing surfaces, and a support element pivotably mounted about a second pivot point and arranged to urge the stripping element towards the arcuate surface, the first pivot point lying at or closely beyond a tangent of the arcuate surface originating opposite the leading edge when in use, and the second pivot point lying at or closely beyond a line extending through the leading edge and the first pivot point.

19 Claims, 2 Drawing Figures

SHEET STRIPPER

This invention relates to sheet stripping apparatus, and more particularly to sheet stripping members with controlled spacings and forces suitable for curved photosensitive surfaces.

In sheet feeding apparatus it is necessary to strip effectively the sheets from the previous transport elements of the sheet feeding apparatus. Numerous techniques are known, including mechanical stripper fingers, for which this is an improvement.

It is known in the electrostatographic art to position a mechanical stripper finger closely adjacent the photoconductive imaging surface of a xerographic drum in order to catch the lead edge of a copy sheet emerging from the electrostatic image transfer area, to thereby initiate stripping of the copy sheet away from the drum imaging surface. Examples of art in this area include U.S. Pat. Nos. 3,450,402, issued June 17, 1969, to E. A. H. Weiler; and 3,578,859, issued May 18, 1971, to W. K. Stillings. Although for an adhesive applicator device rather than a copier, the picker knives 19 of U.S. Pat. No. 3,608,515, issued Sept. 28, 1971, to P. E. Tobias, are specifically noted. Other types of pneumatic, electrostatic, etc., stripping means for stripping sheets from a surface are, of course, known. The above-cited references may be incorporated by reference herein to the extent their disclosures are relevant and appropriate.

The provision of a stripper finger for use with an arcuate supporting surface such as a cylindrical photoreceptor of an electrostatographic copying machine presents particular difficulties. The arcuate surface tends to move radially at least to some extent due to "run out" or excentricity of the drum. Also the sheet can be held or "tacked" against the arcuate surface by surface tension and/or electrostatic fields, making it difficult to strip. Finally, the photoreceptor surface may be easily worn, scratched, contaminated or otherwise damaged in a manner producing visable copy defects.

Accordingly, there is disclosed here a stripping device for stripping sheets from an arcuate surface where said stripping device comprises a stripping element having bearing surfaces adjacent its leading and trailing ends and arranged to be pivotably connected to a support element at a first pivot point at least substantially equidistant said bearing surfaces, and a support element pivotably mounted about a second pivot point and arranged to urge said stripping element towards said arcuate surface, said first pivot point lying at or closely beyond a tangent of said arcuate surface originating opposite said leading edge when in use and said second pivot point lying at or closely beyond a line extending through said leading edge and said first pivot point.

A stripping device according to the present invention enables the desired accurate close juxtaposition with the arcuate surface of the sharp leading edge of the stripping element to be achieved even if the arcuate surface moves radially to some extent as it moves past the stripping element. There is much less tendency, if any, for the leading edge of said element to contact and damage the arcuate surface, because the position of the leading edge is controlled by both leading and trailing bearing surfaces.

A further feature and advantage is achieved where the bearing surfaces of the stripping element are formed by deposition of bearing material. The deposited layer of bearing material provides the separation of the leading edge of the stripper element from the arcuate surface. This can be relatively economically achieved and very accurately controlled during manufacture, since deposition techniques can be readily controllable to accurate depth (thickness) tolerances.

A stripping device according to the invention will now be described by way of example with reference to the accompanying drawings in which.

Figure 1:
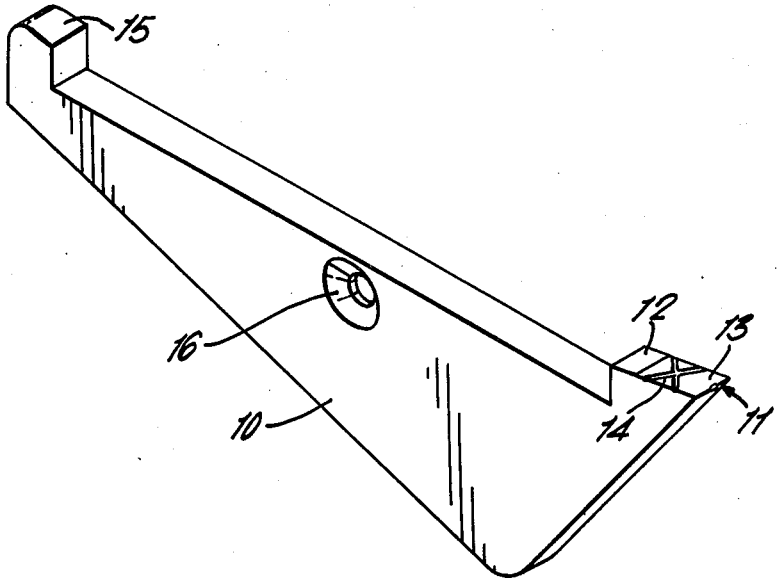
FIG. 1 shows isometrically the stripping element.

Referring to FIG. 1, the stripping element 10 has a leading edge 11 and a leading bearing surface 12 adjacent the leading edge 11, but separated therefrom by a common flat surface 13. The surface 13 carries grooves 14. A trailing bearing surface is shown at 15. Equidistant the surface 12 and 15 is provided a hole, the center of which forms a first pivot point 16 lying closely adjacent a line extending from the surface 13.

The element 10 is formed of hard steel and the bearing surface material is deposited onto the element by electro deposition after the element 10 has been otherwise machined to size. The depth of the bearing surface material deposited can be readily and carefully controlled in accordance with established deposition techniques. Such techniques are inherently controllable to close tolerances, and non-deposition areas can be masked during the deposition process.

In one electrostatic copier, using a liquid development process, for example, the residual toner remaining on the surface of the photoreceptor is found to be approximately 10 microns thick. For a stripper element for use with a photoreceptor of such a copier we arrange the bearing surface to be approximately 20 microns deep. The leading edge 11 is thus supported in use at around 20 microns from the arcuate surface of the photoreceptor and readily strips the leading edge of any sheet moving with the arcuate surface towards the element 10. It will be noted that build-up of excess toner under the surface 13 is prevented by spillage assisted by the grooves 14.

The angle subtended by the leading edge 11 is approximately 40°.

Figure 2:
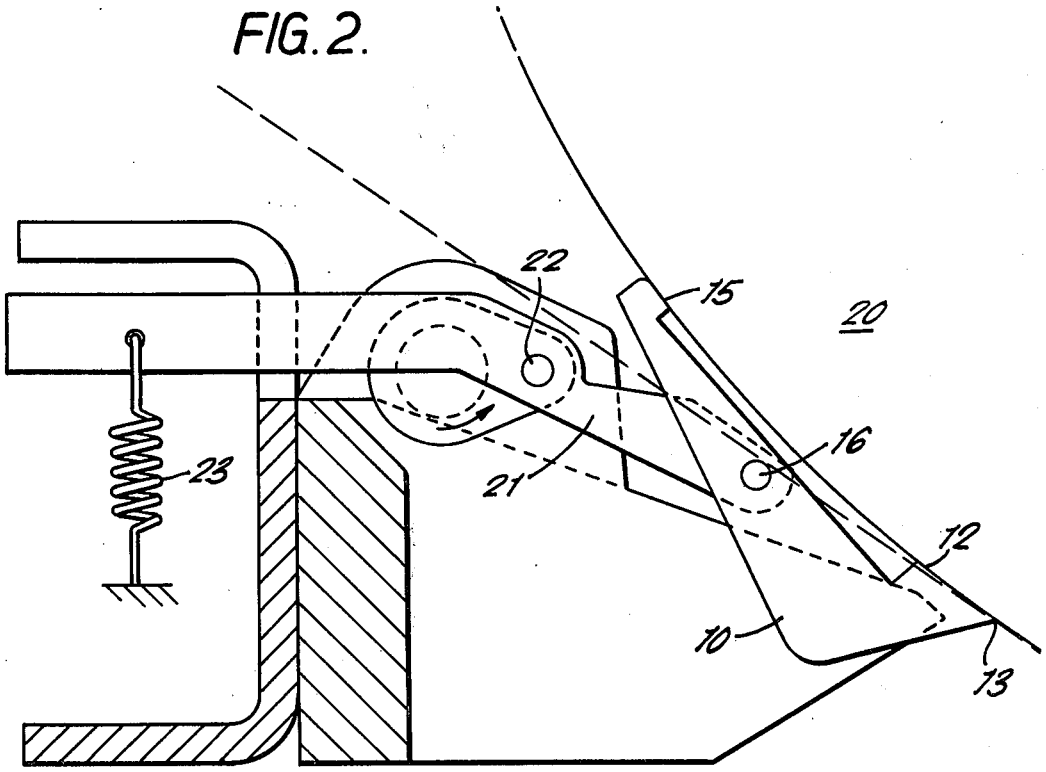
FIG. 2 shows schematically the stripping device.

Referring to FIG. 2, the stripping element 10 is shown with its bearing surfaces in contact with the arcuate surface of a photoreceptor 20. A supporting element 21 pivoted about a second pivot point 22 is biased by a spring 23 to urge the stripping element 10 towards the surface of the photoreceptor 20.

There is a considerable force on the leading edge 11 especially initially during stripping. To reduce any effect of this force to enhance the radial load on the stripping element 10, the second pivot point 22 is ideally arranged on the tangent formed at the surface of the photoreceptor 20 opposite the leading edge 13. However, if the pivot point were precisely on this tangent the system would tend to be mechanically unstable. A point is preferably chosen close to the tangent to minimize the moment caused by the force of stripping action. In addition, the first pivot point 16 is required to be between the above tangent and a line joining the second pivot point and the leading edge 13.

These above conditions are achieved in embodiments of the invention and tolerances built in to ensure that the relationship of the pivot points is maintained taking into account machining tolerances obtainable with the pivotable connections of the elements.

In practice we arrange the radial load or biasing of the stripping element towards the arcuate surface in the embodiment described to be 2 grams. This load can vary according to different applications and scales. In general, one should choose the minimum loading, to reduce as far as possible the rubbing force of the bearing surfaces 12 and 15 on the surface of the photoreceptor, or other arcuate surface, while maintaining stability of the system. If the loading is too small, for example, the leading edge 11 can tend to be unstable in that it moves away from the arcuate surface readily if there are shocks, such as vibrations, in the system.

Bearing materials which are at least generally satisfactory include silver, chromium alloy, nickel and an alloy of copper lead and zinc. Further in another embodiment we form the stripping element including the bearing surfaces of tungsten carbide. This is formed by machining from a solid block. It is not generally practical to deposit satisfactorily materials onto tungsten carbide, and other materials which could be used for the stripping element, by electro-deposition.

In the described embodiment, the stripping angle is 40°. Satisfactory results have been achieved with the configuration described using angles in the range 20° to 50° although we have found that at least approximately 40° provides the most satisfactory results.

One example is a leading edge of the stripping element with a hard radius of less than 0.0002 inches spaced from the photoreceptor surface (by the adjacent plated bearing layer on the same planar stripping element surface) by between 0.0004 and 0.0008 inch, so as to catch a normal thickness copy sheet lead edge below the sheet's center line.

The stripping device can be provided with disengaging means to move the device away from the arcuate surface. In some applications it is envisioned that disengagement may take place frequently and periodically in use.

While a particular embodiment of the invention has been described above, it will be appreciated that various modifications may be made by one skilled in the art without departing from the scope of the invention as defined in the appended claims.

What is claimed is:

1. In a copier, a sheet stripping device for stripping copy sheets from an arcuate imaging surface; said stripping device comprising a support element and a stripping element with a stripping leading end; said stripping element having spaced apart bearing surfaces for bearing said stripping element against said arcuate surface, said bearing surfaces being located adjacent the leading and trailing ends of said stripping element; said stripping element being pivotably connected to said support element at a first pivot point located on said stripping element intermediate said bearing surfaces; said support element being pivotably mounted about a second pivot point to urge said stripping element towards said arcuate surface; said first pivot point being located closely adjacent the line of the tangent of said arcuate surface at said leading end when said bearing surfaces are bearing against said arcuate surface; and said second pivot point lying closely adjacent a line extending through said leading end and said first pivot point.

2. The stripping device of claim 1, wherein said bearing surfaces are formed by coating bearing material onto said stripping element.

3. The stripping device of claim 2, wherein at least the leading end of said stripping element is formed of a hard metal.

4. The stripping device of claim 3, wherein said bearing material is selected from the group of silver, chrome, nickel and an alloy of copper, lead and zinc.

5. The stripping device of claim 1, in which said leading end subtends an angle in the range of 20° to 50°.

6. The stripping device of claim 5, wherein said leading end subtends an angle of at least approximately 40°.

7. The stripping device of claim 1, wherein said stripping element is provided with transverse grooves between said leading end and the bearing surface adjacent said leading end.

8. The stripping device of claim 1, further including spring loading means acting on said support element beyond said second pivot point to urge said stripping element against said arcuate surface.

9. The stripping device of claim 1, wherein said stripping element is recessed away from said arcuate surface between said bearing surfaces and said bearing surfaces are two minor surface areas on said stripping element.

10. The stripping device of claim 1, wherein said first pivot point is located substantially equidistantly between said bearing surfaces.

11. The stripping device of claim 10, wherein said stripping element is recessed away from said arcuate surface between said bearing surfaces and said bearing surfaces are two minor surface areas on said stripping element.

12. The stripping device of claim 11, wherein said stripping element is provided with transverse grooves between said leading end and the bearing surface adjacent said leading end.

13. The stripping device of claim 1, wherein the first pivot point is located between said arcuate surface and a line joining said second pivot point and said leading end.

14. In a copier, a sheet stripping device for stripping copy sheets from an arcuate imaging surface; said stripping device comprising a support element and a stripping element with a stripping leading end, said stripping element having spaced apart bearing surfaces for bearing said stripping element against said arcuate surface, said bearing surfaces being located adjacent the leading and trailing ends of said stripping element; said stripping element being freely pivotably connected to said support element at a pivot point located on said stripping element centrally between said bearing surfaces; said support element being mounted to urge said stripping element towards said arcuate surface; said first pivot point being located adjacent said arcuate surface, and said stripping leading end being held out of contact with, but in close juxtaposition with, said arcuate surface by said bearing surface located adjacent the leading end of said stripping element when said bearing surfaces are bearing against said arcuate surface.

15. The stripping device of claim 14, wherein said bearing surface adjacent said leading end is formed by coating a controlled layer of bearing material onto said stripping element.

16. The stripping device of claim 15, wherein at least the leading end of said stripping element is formed of a hard metal.

17. The stripping device of claim 14, wherein said stripping element is provided with angled transverse grooves between said leading end and the bearing surface adjacent said leading end.

18. The stripping device of claim 14, wherein said stripping element is recessed away from said arcuate surface between said bearing surfaces and said bearing surfaces are only two minor surface areas on said stripping element.

19. The stripping device of claim 18, wherein said pivot point is located substantially equidistantly between said bearing surfaces.

* * * * *